United States Patent [19]

Royal

[11] 4,052,933

[45] Oct. 11, 1977

[54] TRAY FORMING METHOD

[75] Inventor: Thomas B. Royal, Homestead, Fla.

[73] Assignee: International Paper Company, New York, N.Y.

[21] Appl. No.: 705,619

[22] Filed: July 15, 1976

Related U.S. Application Data

[62] Division of Ser. No. 526,826, Nov. 25, 1974, Pat. No. 3,978,774.

[51] Int. Cl.[2] ..... B31B 1/46

[52] U.S. Cl. ..... 93/51 M

[58] Field of Search ..... 93/51 M, 51 HW, 51 R, 93/49 M, 49 R, 47, 45; 229/32

[56] References Cited

U.S. PATENT DOCUMENTS

| | | | |
|---|---|---|---|
| 2,665,836 | 1/1954 | Rendall | 229/32 |
| 2,714,344 | 8/1955 | Baker | 93/51 HW |
| 2,820,403 | 1/1958 | Plough et al. | 93/51 HW |
| 3,015,431 | 1/1962 | Mulcoy | 229/45 |
| 3,975,994 | 8/1976 | Nakane | 93/51 HW |

*Primary Examiner*—James F. Coan

*Attorney, Agent, or Firm*—Richard M. Barnes

[57] ABSTRACT

A machine which forms a tray from a flat blank wherein the formed tray has horizontally disposed shoulders extending across the top thereof.

2 Claims, 9 Drawing Figures

TRAY FORMING METHOD

This application is a division of application Ser. No. 526,826 filed Nov. 25, 1974, now U.S. Pat. No. 3,978,774.

BACKGROUND OF THE INVENTION

This invention relates to the box forming art. More particularly, this invention relates to a method and apparatus for forming a tray from a paperboard flat blank, wherein the formed tray includes a pair of horizontally disposed shoulders at opposite ends of the tray. When the formed tray is used, the horizontally disposed shoulders facilitate stacking and also function to retain articles within the tray which are located adjacent to the end walls thereof.

The automtic formation of such a tray from a flat blank is a particularly difficult task because, when the tray is formed, the horizontally disposed shoulder panels close off a portion of the top opening of the tray. As a result, the area of the opening at the top of the tray is smaller than the area of the bottom of the tray. Generally, paperboard trays are formed on automatic tray forming machines wherein a mandrel is employed in such a manner that the box blank is wrapped arond the mandrel during the forming sequence. After the tray is formed, the mandrel is vertically withdrawn from the tray. However, with trays of the type hereinbefore described, i.e., trays with horizontally disposed shoulder panels, a conventional mandrel cannot be employed because, after the tray is formed, the horizontally disposed shoulder panels would inhibit vertical withdrawal of the mandrel. Additionally, conventional tray forming machines do not include appropriate folding means for correctly positioning the shoulder panels and the maintaining panels connected thereto.

The machine hereinafter disclosed accepts appropriately cut and scored flat blanks and automatically folds each blank to form a tray having a horizontally disposed shoulder panels.

SUMMARY OF THE INVENTION

An automatic tray forming machine which includes a mandrel mounted on the frame of said machine for vertical, reciprocating movement through a box forming station. Means are provided for storing a quantity of flat blanks having a bottom panel, side panels and end panels foldably connected to opposite edges of said bottom panel, a pair of end flaps connected to oppposite end edges of said side panels, a pair of shoulder panels connected to respective side edges of said side panels and a pair of connecting tabs connected to opposite ends of each of said shoulder panels.

When the machine is operated, a blank of the type described above is positioned above a box forming station. Thereupon, the mandrel descends and pushes the blank downwardly through the box forming station. During the downward movement of the blank, the side panels, end panels and end flaps are substantially folded. Additionally, said connecting tabs are at least partially folded during the downward movement. At the end of the downward movement of the mandrel, the mandrel is transversely expanded. Thereupon, folding means function to fold the shoulder panels horizontally. While the shoulder panels are maintained in a horizontal position, transverse compression plates are actuated so as to squeeze together the end panels, end flaps and connecting tabs located at each end of the tray.

When the tray is completely formed, the mandrel is contracted to its original size whereupon it may be vertically withdrawn from the formed tray.

DESCRIPTION OF THE PREFERRED EMBODIMENT

Figure 1:
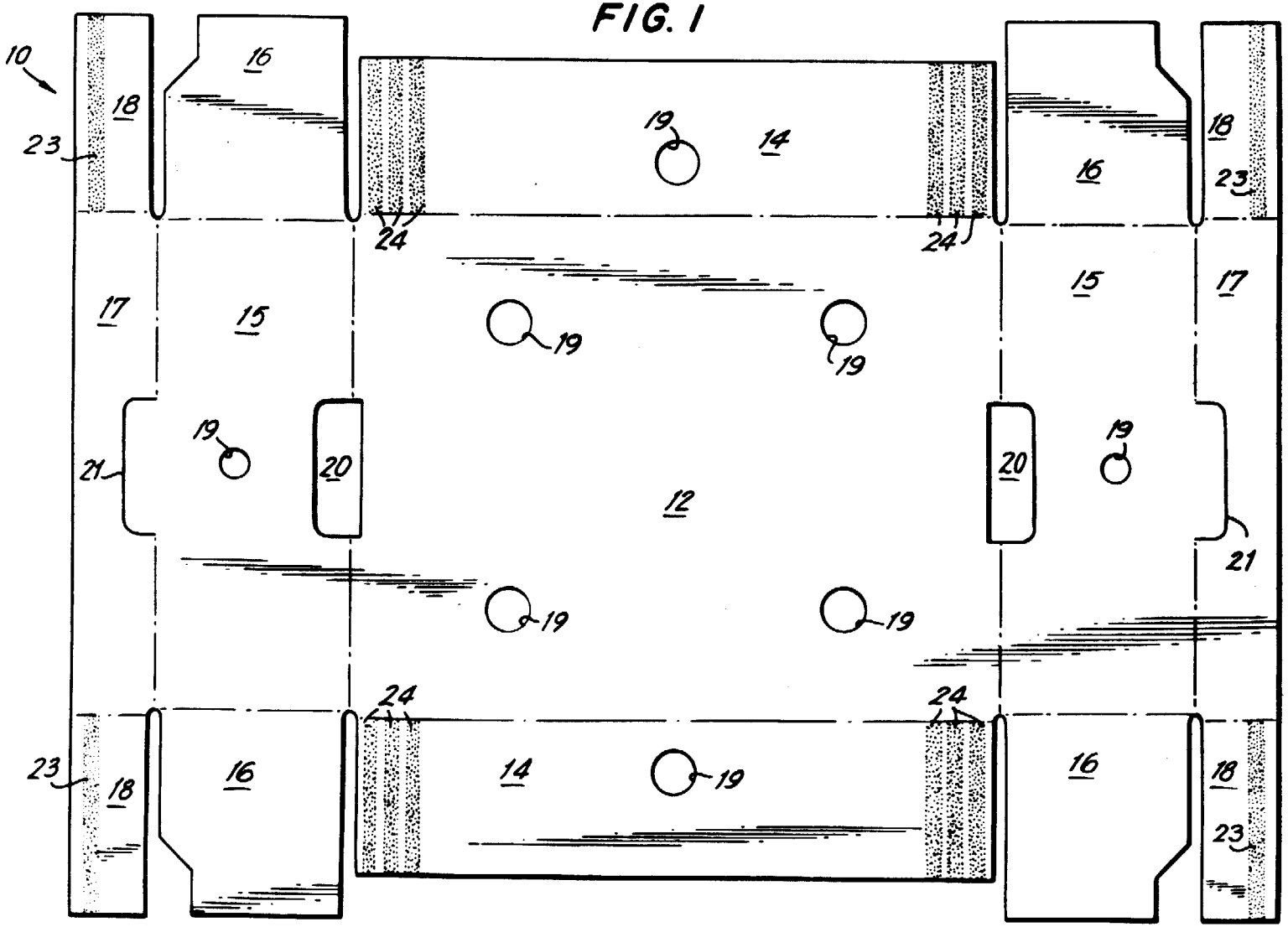
FIG. 1 is a plan view of a blank of the type which may be processed on an apparatus embodying my invention.

FIG. 1 shows in plan view a blank of the type which may be processed on an apparatus which embodies my invention. More specifically, referring to FIG. 1 there is shown a blank 10 which is comprised of a bottom panel 12, side panels 15 and end panels 14. A pair of end flaps 16 are foldably connected to opposite end edges of each of the side panels 15. a pair of shoulder panels 17 are foldably connected to respective side panels 15. A pair of connecting tabs 18 are connected to respective end edges of each of the shouder panels 17. for a variety of reasons known to those skilled in the art, the blank 10 shown in FIG. 1 may provided with apertures 19. Similarly, elongated apertures 20 may be provided together with the tab cut lines 21.

Prior to forming the blank 10 into a box or tray, it is advantageous to deposit thereon patterns of adhesive, for example the adhesive patterns 23 on the connecting tabs 18 and the adhesive patterns 24 on the end panels 14.

Figure 2:
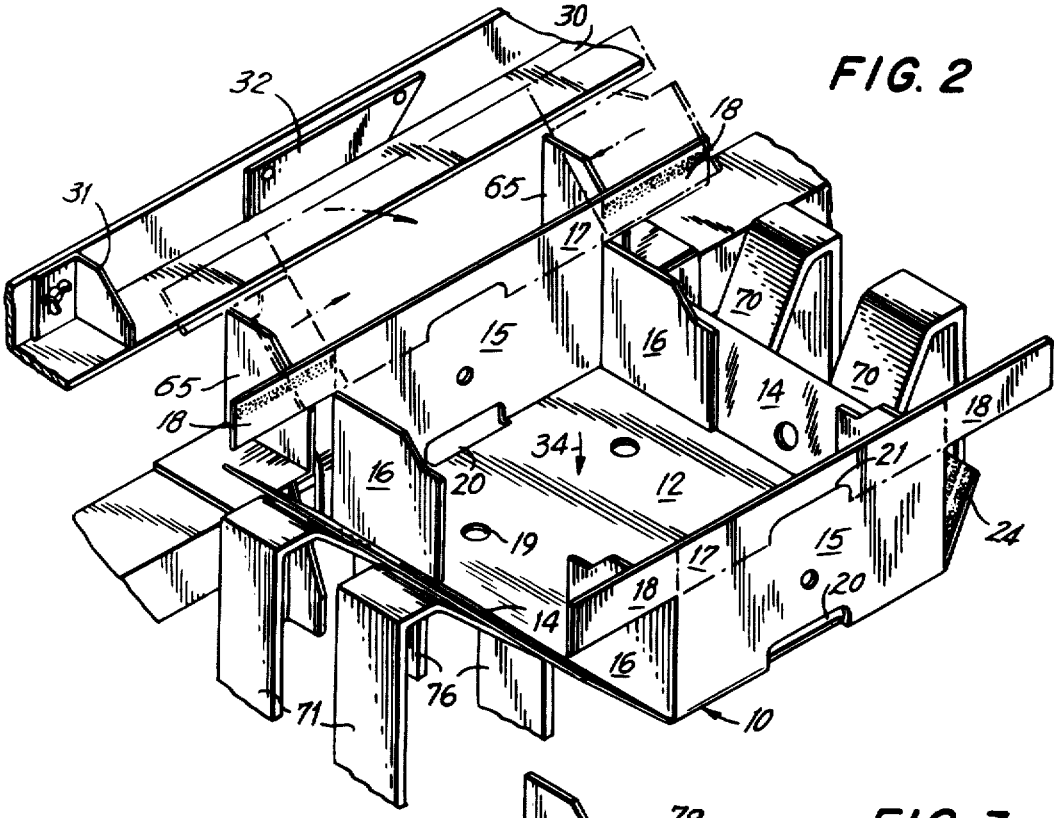
FIGS. 2–5 are perspective, diagramatic representations of certain steps in the forming of a box in accordance with my invention and certain apparatus elements associated therewith.

In the first step in the practice of my box forming method, a flat blank of the type shown in FIG. 1 is disposed horizontally above a box forming station and then pushed downwardly through the box forming station. Referring to FIG. 2, one of the first steps in the practice of my method is shown. More specifically, there are provided two blank support members 30, only one of which is shown in FIG. 2. The support members cooperate to maintain a blank in a horizontal position prior to commencing the forming operation. In this connection, a stop membr 31 may be mounted on each of the support members 30 in order to insure accurate, longitudinal positioning of the blank. Also, a plate 32 may be mounted on the inner, vertical side of each of the support members 30 such that the lower edge of the plate is spaced above the horizontal surface of the support member 30. In this manner, when the blank is fed to the forming portion of the machine the terminal side edges of the blank will be disposed beneath the plate 32.

As suggested by the arrow 34 in FIG. 2, the initial step in the formation of a tray is a downward movement of the blank. As a result of the downward movement and the intereaction of portions of the blank with portions of the box forming station, the side panels 15 are folded to a position substantially perpendicular to the bottom panel 12. Similarly, the end flaps 16 are folded to a position substantially perpendicular to the side panels 15.

Figure 3:
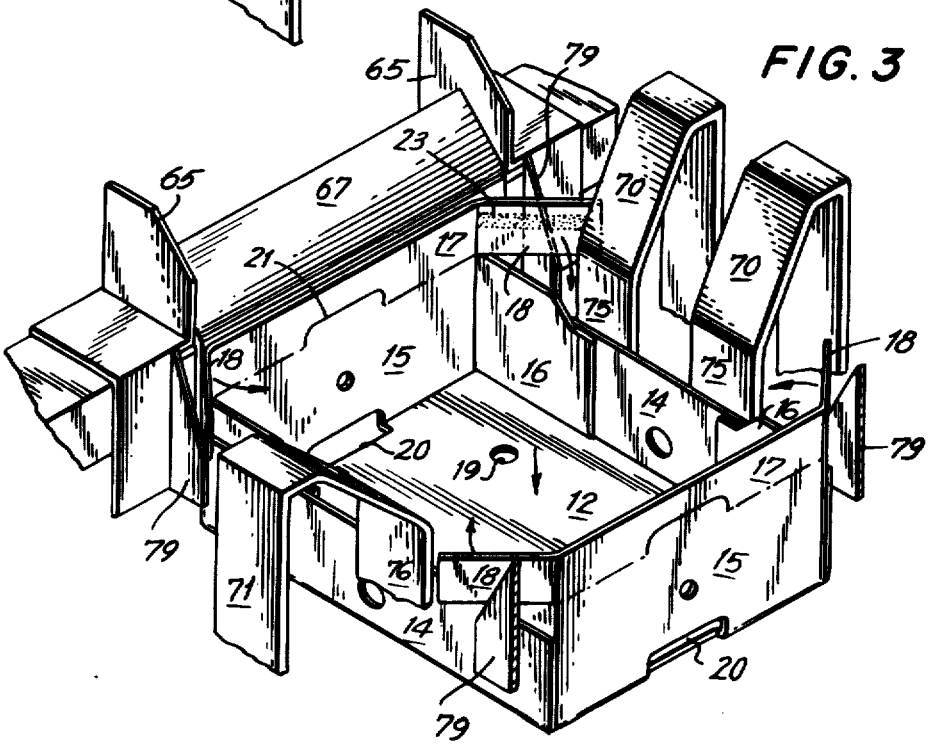

Further downward movement brings the blank 10 to the position shown in FIG. 3 wherein it will be seen that the end panels 14 have been substantially, vertically folded. Additionally, it will be seen that at this stage of the forming process, the connecting tabs 18 have been partially folded.

At this point, it is constructive to consider the mechanisms and machine elements which cooperate to achieve the folding sequences heretofore and hereafter described. Thus referring to FIG. 7 there are shown the two support members 30, the two stop members 31 and one of the retaining plates 32. As shown in phantom in FIG. 7, a mandrel assembly is reciprocably mounted above the forming station generally referred to by the reference number 42. The mandrel assembly 40 is mounted on a cross frame member 43. More specifically, guide blocks 44 are fixedly secured to the frame member 43. Guide rods 45 are slidably received in the guide blocks 44. The lower end of the guide rods 45 are secured to a plate 46. Also secured to the plate 46 is a piston 47 which is operatively received in the cylinder 49, the cylinder 49 being fixedly secured to the frame member 43.

Figure 6:
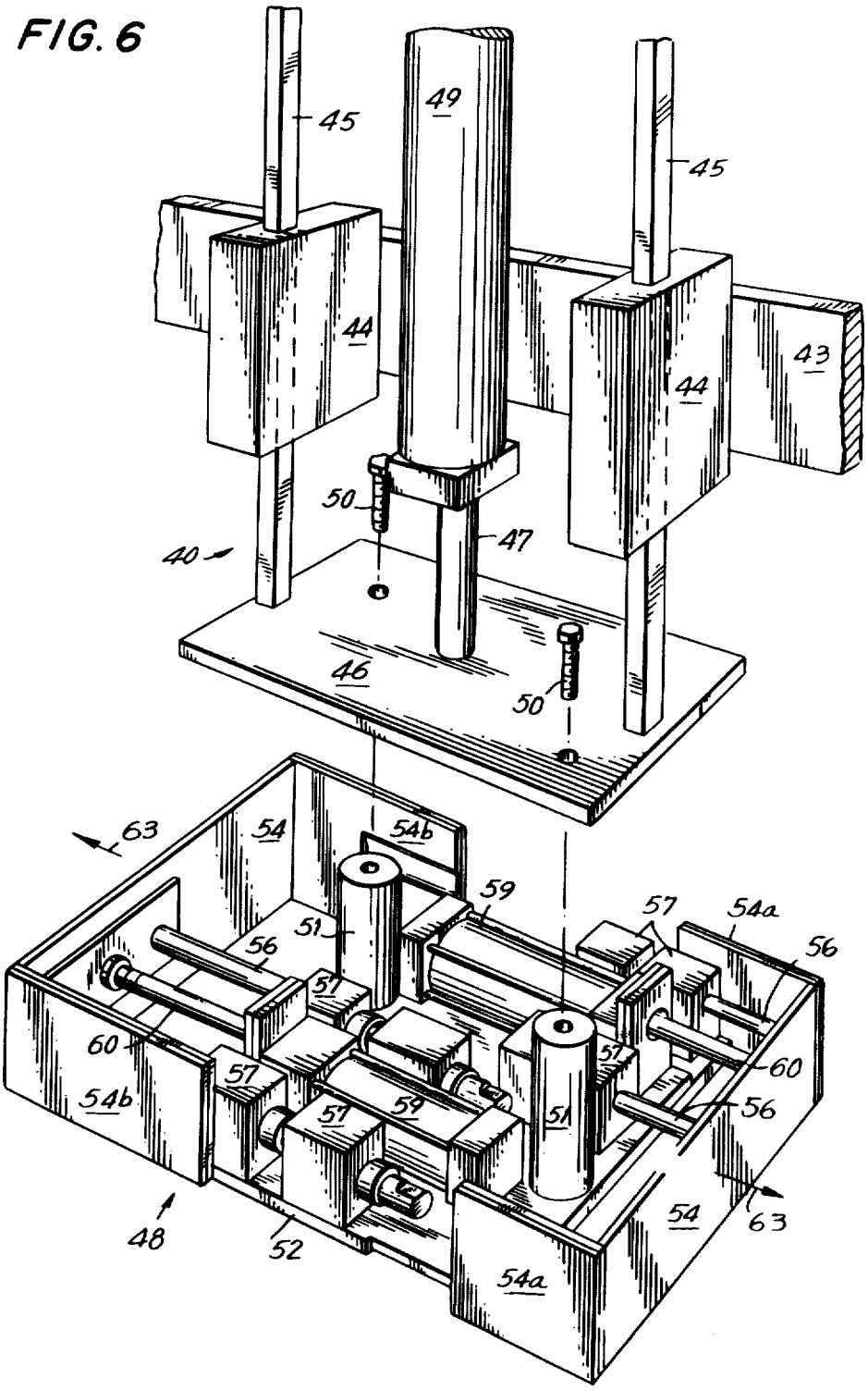
FIG. 6 is a perspective view of a sub-combination useful in the practice of my invention.

As best seen in FIG. 6, the mandrel, generally referred to by reference number 48, is secured to the plate 46, for example by the use of bolts 50. The bolts 50 may be received in stand-off blocks 51 which are secured to the base plate 52 of the mandrel 48.

Figure 7:
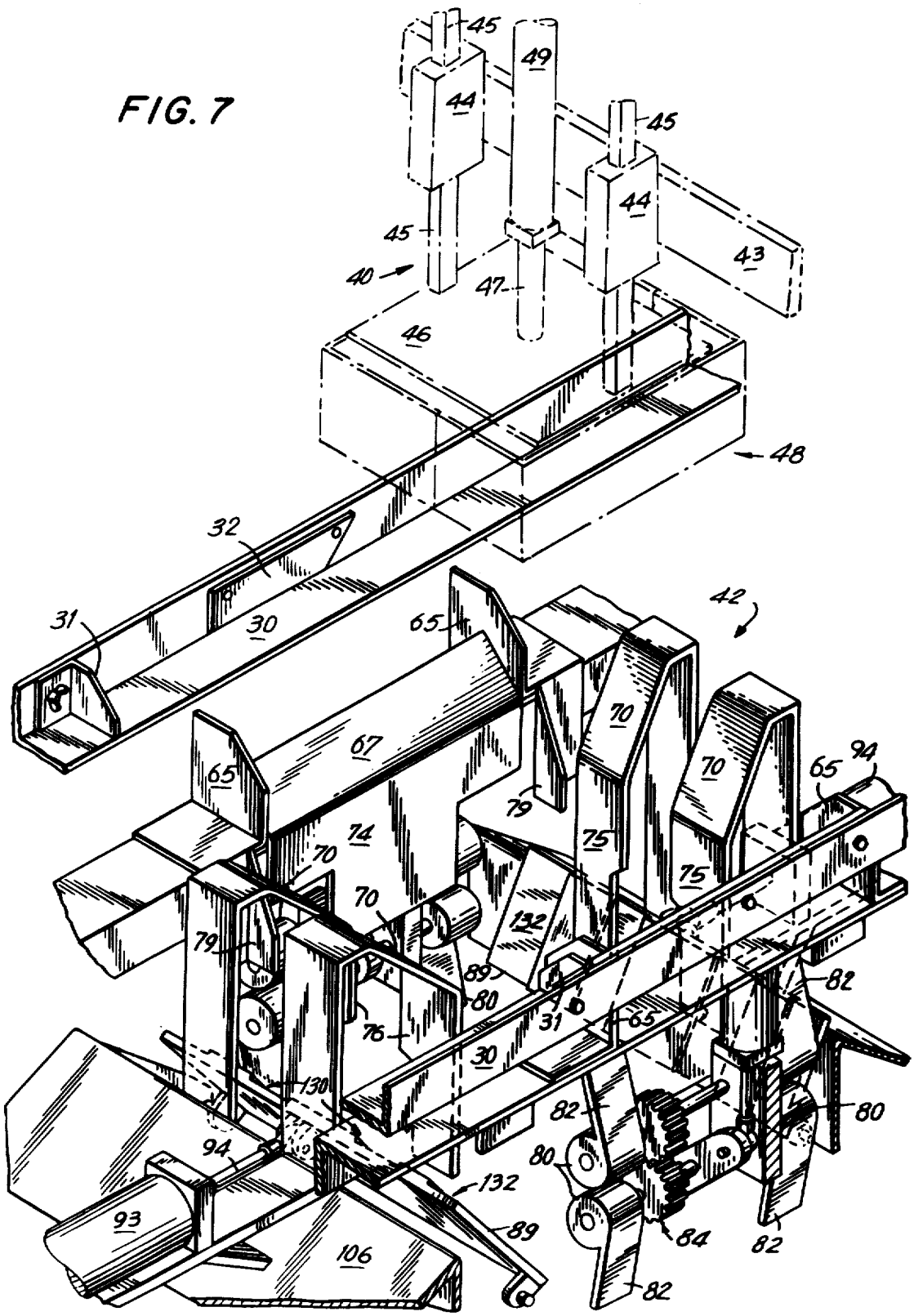
FIG. 7 is a fragmentary perspective view of a portion of an apparatus embodying my invention.

The mandrel 48 is expandable and contractable. In FIG. 6 the mandrel is shown in its expanded state. In order for the mandrel 48 to be expandable, the sides 54 thereof are slidably mounted with respect to the base plate 52. Thus, each side wall 54 includes a pair of fixedly mounted, inwardly extending guide shafts 56. The guide shafts 56 are slidably received in mounting blocks 57 which, at there lower surface, are secured to the base plate 52. In this manner, each of the side plates 54 and attached end plates 54*a*, 54*b* are movably mounted with respect to the base plate 52. To provide movement of the side plates 54, i.e., to expand and contract the mandrel, a double-acting piston cylinder is associated with each of th side plates 54. More specifically, a cylinder 59 is fixedly mounted on a base plate 52 and the piston 60 associated therewith is secured, at its free end, to the interior face of the plate 54. Thus, it will be seen that when the cylinders 59 are actuated, the side plates 54 will move apart as suggested by the arrows 63 and thus the mandrel will be expanded. Conversely, when the cylinders 59 are reverse actuated, the plates 54 will more toward each other, i.e., the mandrel will be contracted and will assume its minimum transverse dimension. In FIG. 7 the mandrel 48 is shown, in phantom, in its contracted condition.

As previously stated, at the beginning of the forming sequence a flattened blank of the type shown in FIG. 1 is disposed above the box forming station 42 shown in FIG. 7, for example by resting on the support members 30. When the forming sequence commences, the cylinders 59 are actuated to expand the mandrel and the cylinder 49 is actuated thereby driving the mandrel 48 downwardly.

Referring now to FIGS. 2, 3 and 7, after the mandrel initially engages the blank, subsequent downwards movement pushes the blank off the support members 30. Thereupon, the end flaps 16 each engage a respective end flap folding plate 65. As the blank continues to move downwardly the end flaps are thereby initially bent upwardly and subsequently inwardly. As a consequence thereof, the side panels 15 commence to bend upwardly as suggested by the phantom lines in FIG. 2. Upon further downward movement, the side panels 15 engage the side panel folding plates 67 whereupon with further downward movement the side panels are folded perpendicularly with respect to the bottom panel 12. Upon still further downward movement the end panels 14 engage respective end panel folding plates 70 and thus the end panels 14 commence to fold upwardly. As a result, the blank will, at this time, be positioned as shown in FIG. 2.

Upon further downward movement, the side panels 15 pass between parallel, spaced apart plates 74 which are spaced apart a distance approximately equal to the transverse dimension of the bottom panel 12. Similarly, as may best be seen in FIGS. 3 and 7, the end panel folding plates 70 have downwardly directed extensions 75, 76. The extensions 75, 76 are spaced apart a distance substantially equal to the longitudinal dimension of the bottom panel 12. Thus, as the end panels 14 pass from the end panel folding plates 70 is the extensions 75, the end panels are folded to a substantially vertical position, and, thereby, position the end flaps 16 perpendicuarly with respect to the side panels 15 as best seen in FIG. 3.

As may be noted in FIG. 2, during the early part of the downward movement of the blank 10 the connecting tabs 18 extend longitudinally. However, as the blank 10 makes the transition from the position shown in FIG. 2 to the position shown in FIG. 3, the outwardly extending connecting tabs 18 engage the downwardly sloping surfaces of the connecting tab folding plates 79. As a result, during further downward movement of the blank the connecting tabs 18 are rotated about a vertical axis. At the end of the downward movement of the mandrel, the connecting tabs 18 are substantially, but not completely, folded with respect to the shoulder panels 17.

Thus, at the end of the downward movement, the side panels 15 have been folded substantially perpendicularly to the bottom panel 12 and the end flaps 16 have been folded perpendicular with respect to the side panels 15. Additionally, the end panels 14 have been folded to a substantially perpendicular relation with respect to the bottom panel 12 and the connecting tabs 18 have been substantially, but not completely, folded with respect to the shoulder panels 17.

When the expanded mandrel reaches the end of its downward movement, the end panels 14 are still in contact with the doward extensions 75, 76 and are thereby maintained in a substantially vertical plane. At this time, there is a dwell in the vertical movement of the mandrel, during which time a number of folding sequences automatically occur.

Figure 4:
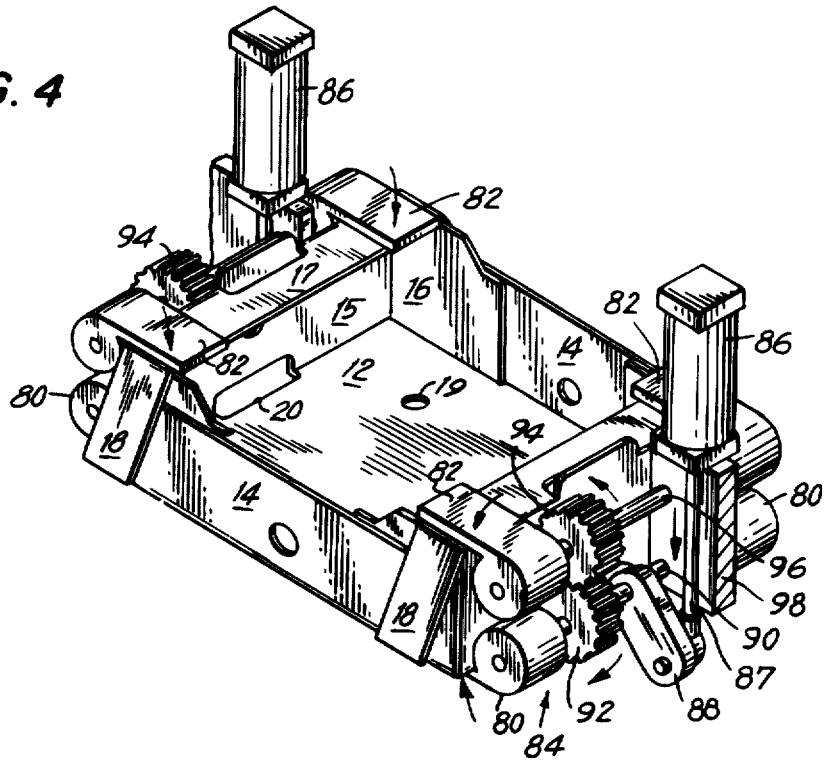

Thus referring to FIG. 4, after the mandrel has stopped, top-to-bottom compressor arms 80, 82, are actuated in order to fold each shoulder panel to a position which is substantially perpendicular to its associated side panel and in order to hold each shoulder panel in a substantially horizontal plane while the remainder of the box is formed. (For clarity, the mandrel has been omitted from FIG. 4). More specifically, on each side of the machine adjacent to the bottom of the box forming station, there are provided a pair of bottom compressor arms 80 and a pair of top compessor arms 82. Each pair of compessor arms are mounted on a common shaft and the two shafts are geared together as shown at 84 in order to secure automatic, opposite rotation of the arms 80, 82. As best seen in FIGS. 4 and 7, a top-to-bottom compressor arm actuating cylinder 86 is provided and includes a downwardly extending piston 87 which is pinned to a crank arm 88. The other end of the crank arm is fixedly secured to the shaft 90. The lower compressor arms 80 and a spur gear 92 are also fixedly secured to shaft 90. The spur gear 92 engages a corresponding spur gear 94 which is fixedly secured to the shaft 96 as are the top compressor arms 82. The shafts 90, 96 are journaled in mounting blocks 98. Thus, it will be seen that when the cylinder 86 is acutated, the piston 87 will move downwardly causing a clockwise rotation of the gear 92 and the bottom folding arms 80. Additionally, a clockwise rotation of gear 92 will cause counter clockwise rotation of the gear 94 thereby causing the top compessor arms 82 to rotate downwardly. In this manner, the top compessor arms 82 perpendicularly fold the shoulder panels 17 with respect to the side panels 15 while the box is gripped along the bottom panel by the lower compressor arms 80.

Figure 5:
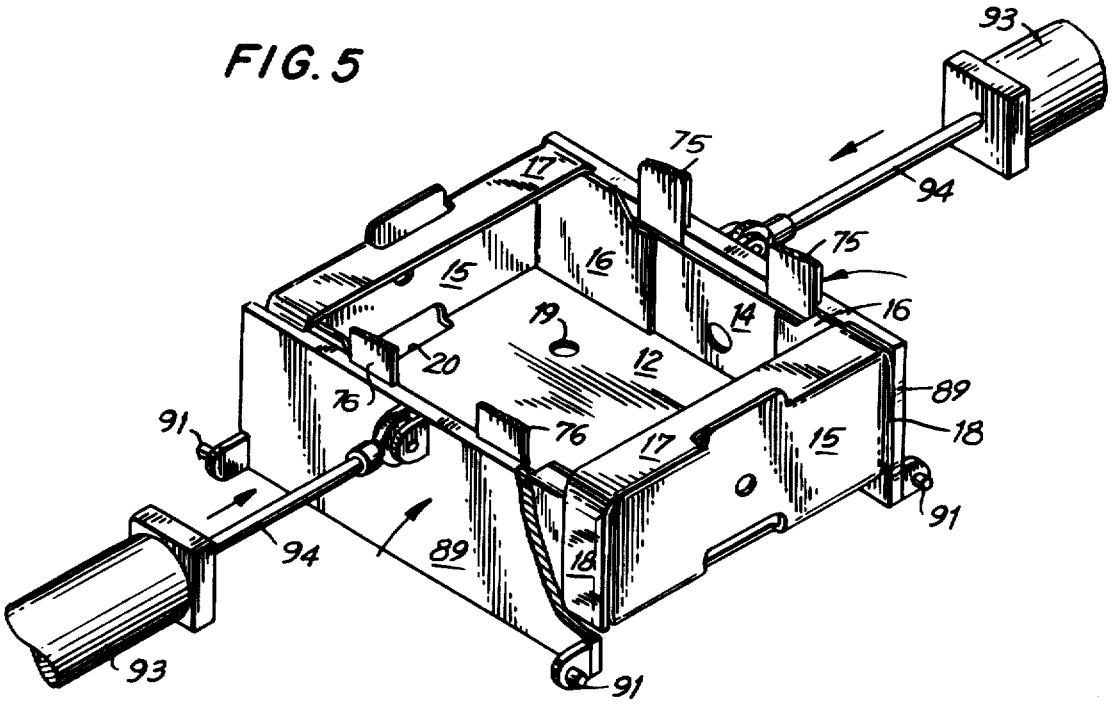

While the mandrel is in its expanded condition and while the top and bottom compressor arms 80 and 82 are in their actuated position, the connecting flaps 18, the end panels 14 and the end flaps 16 are squeezed together. Referring to FIGS. 5 and 7, the apparatus elements necessary to effect this step are shown. Specifically, a pair of squeezer plates 89 are transversely and rotatably mounted adjacent to the bottom of the box forming station 42. The plates 89 may advantageously be pinnned to the frame of the machine by pins 91. A pair fo double-acting cylinders 93 are fixedly mounted to the frame of the machine and longitudinally disposed therein. Associated with each of the cylinders 93 is a piston 94, the free end of which is pinned to the top portion of the plates 89.

Again, it should be noted that in FIG. 5 the mandrel has been omitted for clarity. However, in operation, the mandrel 48 will be disposed within the formed box. Thus, then the cylinders 93 are actuated the end flaps 16, the end panels 14 and the connecting tabs 18 are compressed between the plates 89 and the outer transverse sides of the mandrel.

Preferably, the plates 89 are provided with recessed areas 130 and 132 in order to accommodate the extensions 75, 76 and the added thickness of the connecting tabs 19, respectively. The plates 89 are maintained in their actuated position for a time sufficient to allow a previously deposited adhesive pattern to set, i.e., preferably, the adhesive pattern shown in FIG. 1 is deposited on the blank prior to the blank being delivered to the box forming station. Thus, comparing the blank and adhesive pattern shown in FIG. 1 with the compressing step shown in FIG. 7, it will be seen that an adhesive is appropriately deposited on the blank so as to insure that upon compression, the connection tabs 18 will be adhesively secured to the end panels 14 and the end panels will be adhesively secured to the end flaps 16. When a sufficient period of time has elapsed to insure setting of the adhesive, the cylinders 93 are reverse actauted, the cylinders 59 attached to the mandrel base plate are reverse actuated thus contracting the mandrel to its minimum size so that it may pass between the horizontally disposed shoulder panels 17. Thereupon, the cylinder 49 is reverse actuated so as to retract the mandrel. After the mandrel has been retracted, i.e., at least after the mandrel moves upwardly out of the formed box, the cylinders 86 shown in FIG. 4 are reverse actuated thus opening the top-to-bottom compressor arms. Thereafter, the next tray that is formed will push the preceding tray downwardly through the box forming station and preferably on to an inclined series of rollers positioned beneath the box forming station.

Figure 8:
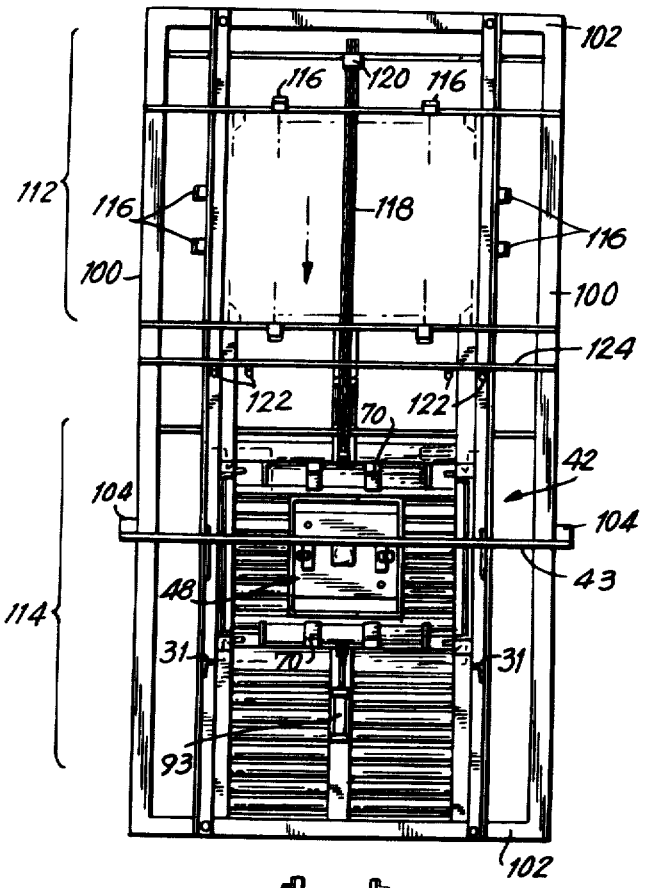
FIG. 8 is a top view of an apparatus constructed in accordance with my invention.
Figure 9:
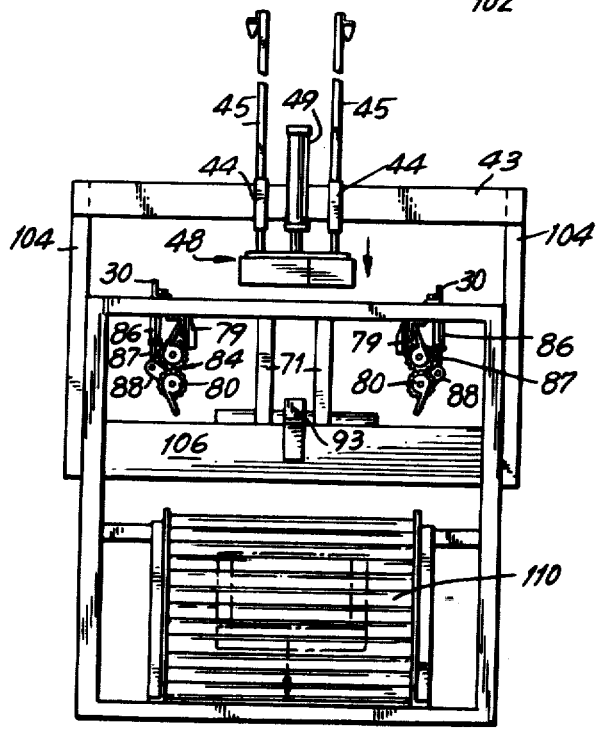
FIG. 9 is a front view of the apparatus shown in FIG. 8.

Referring to FIGS. 8 and 9 there is shown a top view and side view, respectively, of an entire machine constructed in accordance with my invention. A number of the machine elements hereinbefore described are shown in FIGS. 8 and 9, however, certain of said elements have been omitted for clarity. However, those skilled in the art will easily perceive the relation of the elements hereinbefore described to those shown in FIGS. 8 and 9 and it will be clear to those skilled in the art how to appropriately mount all of said elements.

Referring to FIGS. 8 and 9, it will be seen that the machine includes longitudinal frame members 100 and transverse frame members 102. As may be seen in FIG. 8, the support members 30 are mounted longituidinally of the machine. The cross frame member 43, from which the mandrel 48 depends, is mounted on the machine by vertical frame members 104. Disposed beneath the box forming station 42 is a downwardly sloping roller assembly, i.e., a series of transversely mounted rollers so disposed such that a formed box falling out of the box forming station will fall upon the roller assembly and discharge from the machine as suggested by the phantom lines in the lower portion of FIG. 9 and as indicated by the reference number 110.

Referring to FIG. 8, it may be seen that the machine may be divided into a blank storage section 112 and a blank forming section 114. The blank storage section is essentially conventional and includes a blank storage hopper defined by vertically extending guide bars 116. Blanks are stored in the hopper defined by the vertically extending guide bars 116 and are stacked in a flat condition. Preferably, a plurality of vertically reciprocating suction cups (not shown) are disposed beneath the lowermost blank and sequentially pull down the lowermost blank. To provide communication between the blank storage section 112 and the box forming station 114, a motor driven chain 118 is provided and includes a dog 120.

Thus, in operation, flat blanks are vertically stacked in the blank storage section and the lowermost blank is fed from the blank storage section 112 to the box forming section 114 by actuating the chain 118 and having the dog 120 engage the trailing edge of the lowermost blank. A blank is shown in phantom in the box forming section of the machine of FIG. 8.

Preferably, a plurality of glue guns are disposed between the blank forming section and the box forming section 114, e.g., the glue guns 122 mounted on the cross frame member 124. Thus, as the blank is fed from the blank storage section 112 to th box forming section 114, the leading edge of the blank may actuate a microswitch or photocell or other appropriate detection device which provides an output signal to actuate the glue guns 122. Preferably the glue guns 122 downwardly discharge a hot-melt adhesive pattern in the manner suggested in FIG. 1. When a blank is fed into the box forming section 114, it slides along the support members 30, under the retaining plates 32 and steps when it abuts the plates 31. Thereupon, the mandrel may be actuated to commence its downward movement and the forming sequence hereinbefore described follows.

Finally, two points should be noted. First, in order to provide a clear and concise description of my invention, the annexed drawings do not include common structural elements which are known or obvious to those skilled in this art. For example, it will be clear to those skilled in this art how to mount the component parts of the box forming station of FIG. 7 within the apparatus of FIGS. 8 and 9. Similarly, as previously indicated, certain components have been omitted from certain views of the drawings in order not bo obscure the invention. This mandrel 48 has been omitted from FIGS. 2 and 3 and in FIG. 3 one of the end panel folding plates 76 was omitted.

Second, those skilled in the art to which my invention pertains will appreciate that certain aspects of my invention, as hereinbefore described, may be varied to accommodate commercial limitations or requirements. For example, some design changes may be required depending upon the size of the tray to be formed. However, such changes are within the compass of those skilled in this art and can be effected without departing from the scope of my invention.

I claim:

1. The method of forming a tray having horizontal shoulder panels from a flat blank having a bottom panel, side panels and end panels foldably connected to opposite edges of said bottom panel, and a pair of shoulder panels connected to resepective side edges of said side panels, said method comprising:

a. disposing said blank in a horizontal plane;
b. pushing said blank downwardly with an expanded expandable mandrel;
c. folding said side panels as said blank moves downwardly;
d. perpendicularly folding said end panels;
e. adhesively connecting said end panels and said side panels;
f. folding said shoulder panels to a position perpendicular to said side panels; and
g. contracting said expandable mandrel and withdrawing said mandrel from said tray.

2. The method of forming a box from a blank having a bottom panel, side panels and end panels foldably connected to opposite edges of said bottom panel, a pair of end flaps for connecting together said side and end panels, a pair of shoulder panels connected to respective side edges of said side panels and a pair of connecting tabs connected to opposite end edges of each of said shoulder panels, said method comprising:

a. disposing said blank in a horizontal plane;
b. pushing said blank downwardly with an expanded expandable mandrel;
c. folding said end panels as said blank moves downwardly;
d. folding said end panels as said blank moves downwardly;
e. folding said end flaps to a position substantially perpendicular to said bottom panel;
f. folding said shoulder panels to a position perpendicular to said side panels;
g. folding said connecting tabs;
h. squeezing together said connecting tabs, said end flaps and said end panels, whereby the expanded expandable mandrel supports said connecting tabs, said end flaps and said end panels during said squeezing; and
i. contracting said expandable mandrel and withdrawing said mandrel from said tray.

* * * * *